US008567370B2

(12) United States Patent
Bidner et al.

(10) Patent No.: US 8,567,370 B2
(45) **Date of Patent: *Oct. 29, 2013**

(54) METHOD AND SYSTEM FOR ENGINE CONTROL

(75) Inventors: David Karl Bidner, Livonia, MI (US); Ralph Wayne Cunningham, Milan, MI (US); Stephen G. Russ, Canton, MI (US); James Hilditch, Canton, MI (US); John Eric Rollinger, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/620,192

(22) Filed: Sep. 14, 2012

(65) Prior Publication Data

US 2013/0013172 A1 Jan. 10, 2013

Related U.S. Application Data

(63) Continuation of application No. 13/354,221, filed on Jan. 19, 2012, now Pat. No. 8,297,255, which is a continuation of application No. 12/841,066, filed on Jul. 21, 2010, now Pat. No. 8,100,107.

(51) Int. Cl.
*F02D 41/30* (2006.01)
*F02B 3/00* (2006.01)

(52) U.S. Cl.
USPC ..... 123/299; 701/104; 701/108

(58) Field of Classification Search
USPC ..... 123/299, 295, 305, 300, 525; 701/103–105, 108, 109
See application file for complete search history.

(56) References Cited

U.S. PATENT DOCUMENTS

| | | | |
|---|---|---|---|
| 5,839,416 | A | 11/1998 | Kruiswyk et al. |
| 7,159,568 | B1 | 1/2007 | Lewis et al. |
| 7,278,396 | B2 | 10/2007 | Leone et al. |
| 7,281,517 | B2 | 10/2007 | Miyazaki et al. |
| 7,287,492 | B2 | 10/2007 | Leone et al. |
| 7,293,552 | B2 | 11/2007 | Leone et al. |
| 7,302,933 | B2 | 12/2007 | Kerns |
| 7,357,101 | B2 | 4/2008 | Boyarski |
| 7,395,786 | B2 | 7/2008 | Leone et al. |
| 7,406,947 | B2 | 8/2008 | Lewis et al. |
| 7,412,966 | B2 | 8/2008 | Lewis et al. |
| 7,424,881 | B2 | 9/2008 | Kerns |
| 7,426,925 | B2 | 9/2008 | Leone et al. |
| 7,428,895 | B2 | 9/2008 | Leone et al. |
| 7,584,740 | B2 | 9/2009 | Boyarski |
| 7,594,498 | B2 | 9/2009 | Lewis et al. |

(Continued)

FOREIGN PATENT DOCUMENTS

| | | | |
|---|---|---|---|
| JP | 7189860 | A | 7/1995 |
| JP | 2006250058 | A | 9/2006 |

*Primary Examiner* — Hieu T Vo
(74) *Attorney, Agent, or Firm* — Julia Voutyras; Alleman Hall McCoy Russell & Tuttle LLP

(57) ABSTRACT

Methods and systems are provided for controlling exhaust emissions by adjusting a fuel injection into an engine cylinder from a plurality of fuel injectors based on the fuel type of the injected fuel and further based on the soot load of the engine. Soot generated from direct fuel injection is reduced by decreasing an amount of direct injection into a cylinder as the engine soot load increases.

22 Claims, 6 Drawing Sheets

(56) References Cited

U.S. PATENT DOCUMENTS

| | | | | |
|---|---|---|---|---|
| 7,640,912 | B2 | 1/2010 | Lewis et al. | |
| 7,640,914 | B2 | 1/2010 | Lewis et al. | |
| 7,647,916 | B2 | 1/2010 | Leone et al. | |
| 7,703,435 | B2 * | 4/2010 | Surnilla et al. | 123/525 |
| 7,789,063 | B2 | 9/2010 | Lewis et al. | |
| 7,913,668 | B2 | 3/2011 | Lewis et al. | |
| 7,942,128 | B2 | 5/2011 | Leone et al. | |
| 7,971,567 | B2 | 7/2011 | Zubeck et al. | |
| 7,971,575 | B2 | 7/2011 | Lewis et al. | |
| 8,100,107 | B2 | 1/2012 | Bidner et al. | |
| 8,297,255 | B2 * | 10/2012 | Bidner et al. | 123/299 |
| 2007/0000478 | A1 | 1/2007 | Sadakane et al. | |
| 2007/0119392 | A1 | 5/2007 | Leone et al. | |
| 2007/0119394 | A1 | 5/2007 | Leone | |
| 2007/0119413 | A1 | 5/2007 | Lewis et al. | |
| 2008/0283023 | A1 | 11/2008 | Lewis et al. | |
| 2009/0070021 | A1 | 3/2009 | Leone et al. | |
| 2009/0188241 | A1 | 7/2009 | Sugiarto et al. | |
| 2009/0281709 | A1 | 11/2009 | Mallebrein et al. | |
| 2009/0320790 | A1 | 12/2009 | Lewis et al. | |
| 2010/0030449 | A1 | 2/2010 | Ikoma | |
| 2011/0146233 | A1 | 6/2011 | Carlill et al. | |

* cited by examiner

METHOD AND SYSTEM FOR ENGINE CONTROL

CROSS REFERENCE TO RELATED APPLICATIONS

The present application is a continuation of U.S. patent application Ser. No. 13/354,221 filed Jan. 19, 2012, now U.S. Pat. No. 8,297,255 B2, issued on 30 Oct. 2012, which is a continuation of U.S. patent application Ser. No. 12/841,066 filed Jul. 21, 2010, now U.S. Pat. No. 8,100,107, the entire contents of each of which are incorporated herein by reference for all purposes.

FIELD

The present application relates to methods and systems for controlling fuel injection in an engine system.

BACKGROUND AND SUMMARY

Engines may be configured with direct fuel injectors that inject fuel directly into a combustion cylinder (direct injection), and/or with port fuel injectors that inject fuel into a cylinder port (port fuel injection). Direct injection allows higher fuel efficiency and higher power output to be achieved in addition to better enabling the charge cooling effect of the injected fuel.

Direct injected engines, however, also generate more particulate matter emissions (or soot) due to diffuse flame propagation wherein fuel may not adequately mix with air prior to combustion. Since direct injection, by nature, is a relatively late fuel injection, there may be insufficient time for mixing of the injected fuel with air in the cylinder. Similarly, the injected fuel may encounter less turbulence when flowing through the valves. Consequently, there may be pockets of rich combustion that may generate soot locally, degrading exhaust emissions.

Thus, the above issue may be at least partly addressed by a method of operating an engine including a first port injector injecting a first fuel into an engine cylinder and a second direct injector injecting a second fuel into the engine cylinder. In one embodiment, the method comprises, adjusting a fuel injection to the cylinder between the first port injector and the second direct injector based on the soot load of the engine.

In one example, an engine may be configured with both direct injection and port fuel injection to the engine cylinders. A fuel injection amount, that is an amount of fuel injected into the cylinder, between the direct injector and the port fuel injector may be adjusted based on the amount of particulate matter (PM) produced by the engine (that is, the engine soot load). In one example, the amount of particulate matter produced by the engine may be sensed and estimated by a particulate matter sensor. In another example, the amount of particulate matter produced may be inferred based on engine operating conditions, such as a speed-load condition of the engine, or based on a differential pressure across a particulate matter filter. The fuel injection amount may be further based on the fuel type.

For example, based on engine operating conditions, a fuel injection profile may be determined including an amount of a first fuel injected through the first port injector, and a second amount of a second fuel injected through the second direct injector. In one example, such as at higher engine speeds and loads, the first amount of port injection may be smaller than the second amount of direct injection. The higher amount of direct injection may be used herein to take advantage of the higher fuel efficiency and power output of the more precise direct injection, as well as the charge cooling properties of the injected fuel.

An amount of particulate matter (soot load) generated during engine operation may be estimated by a sensor and/or inferred based on operating conditions. In one example, as the amount of particulate matter generated exceeds a threshold, the fuel injection ratio may be adjusted. For example, as the soot load exceeds a threshold, a fuel injection amount from the direct injector may be decreased while a fuel injection amount from the port injector may be correspondingly increased. Additional spark timing adjustments may be made based on the fuel injection adjustment to compensate for torque disturbances. Further, an alternate engine operating parameter, such as VCT schedule, boost, EGR, etc., may also be adjusted to compensate for the torque transients.

The increase in fuel injection amount from the port injector may be based on the fuel type of the first fuel while the decrease in fuel injection amount from the direct injector may be based on the fuel type of the second fuel. As such, alcohol fuels may generate less particulate matter than gasoline fuels. Thus, in one example, when the alcohol content of the first fuel is higher, the increase in fuel injection amount from the port injector may be smaller. In another example, when the alcohol content of the second fuel is higher, the decrease in fuel injection amount from the direct injector may be smaller.

A rate of change in the fuel injection amounts may be further adjusted based on a rate of rise in exhaust particulate matters levels (or rate of rise in soot load). In one example, in response to a rate of rise in soot load exceeding a threshold (that is, a sudden and rapid rise in soot levels), the increase in fuel injection amount from the port injector and the decrease in fuel injection amount from the direct injector may be increased. For example, the transition from a larger amount of direct injection to a larger amount of port injection may be substantially immediately. In another example, in response to a rate of rise in soot being lower than the threshold (that is, a gradual rise in soot levels), the transition from the higher amount of direct injection to the higher amount of port injection may be performed at a slower rate (for example, gradually). The transition rate may also be adjusted based on the fuel type.

Further still, the fuel injection may be adjusted based on a regeneration operation of a particulate filter configured to store exhaust PMs. For example, a fuel injection amount from the direct injector may be decreased and a fuel injection amount from the port injector may be increased before filter regeneration, when the soot load of the filter is higher. Then, after regeneration, when the soot load of the filter is lower, and the filter is able to store more exhaust PMs, the fuel injection amount from the direct injector may be increased and the fuel injection amount from the port injector may be decreased. Herein, by increasing the amount of direct injection after filter regeneration, the fuel economy benefits of the direct injection may be achieved while the exhaust PMs generated from the direct injection are stored on the filter.

In this way, by shifting, at least temporarily, to a relatively higher amount of port injection as compared to direct injection in response to a rise in particulate matter (PM) levels, exhaust PM emissions may be reduced without substantially affecting engine fuel economy. Further, by optimizing engine injection for a defined limit of PMs, the advantages of both direct injections and port injections may be availed.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
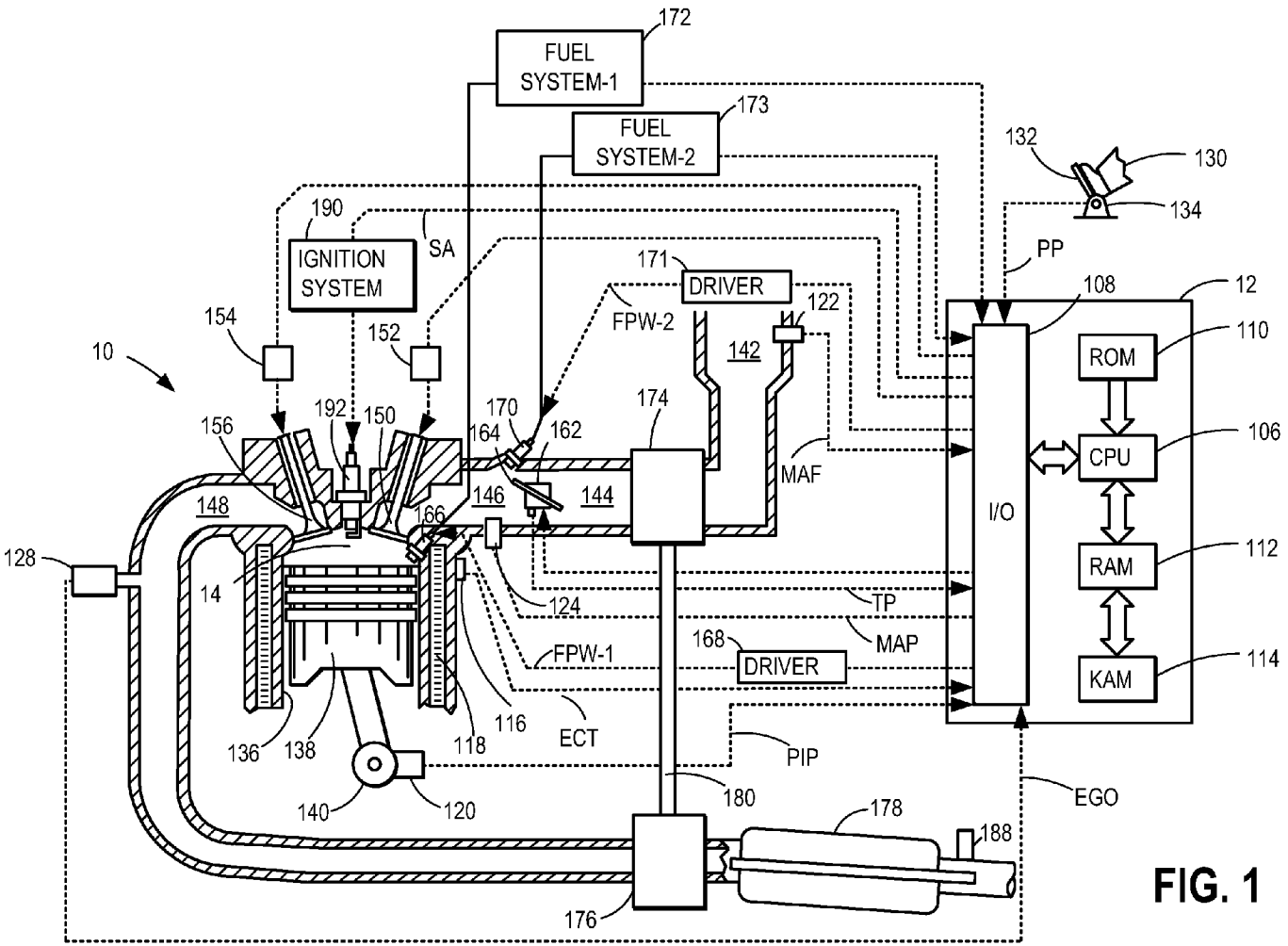
FIG. 1 shows an example combustion chamber.
Figure 4:
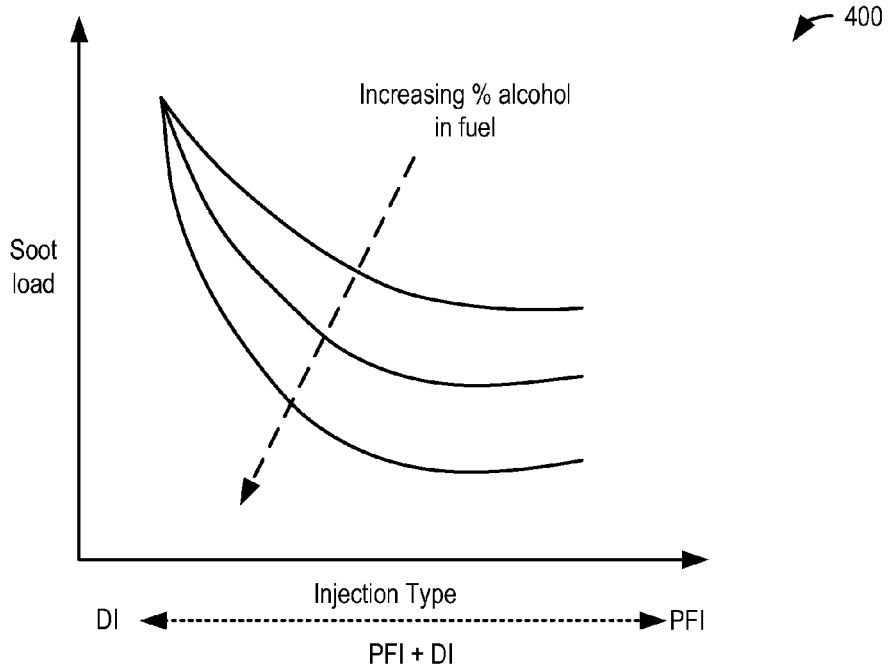
FIGS. 4-5 show example maps of adjustments to fuel injection ratios responsive to increased soot loads for varying fuel types.
Figure 5:
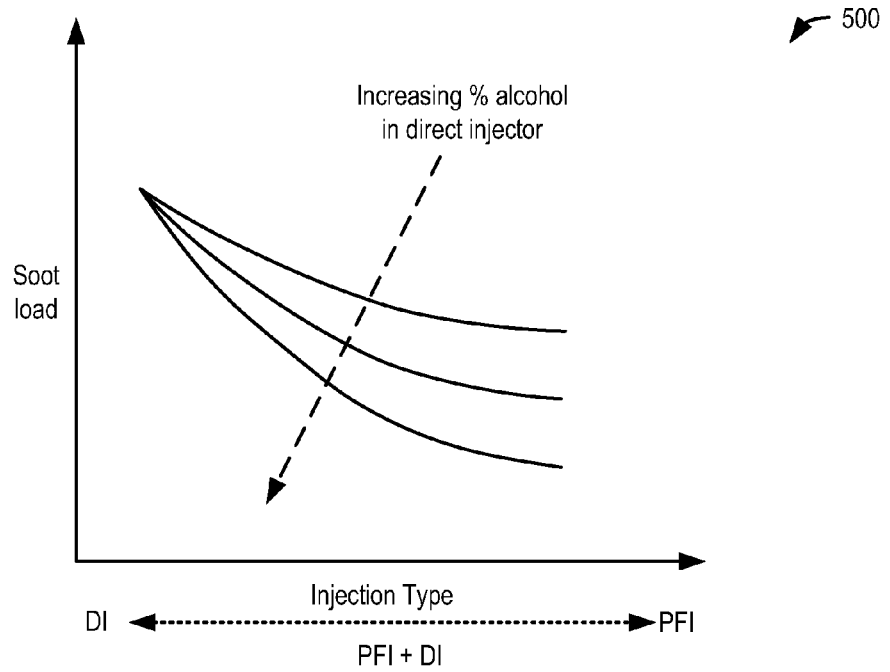

The following description relates to systems and methods for adjusting an engine fuel injection, such as in the engine system of FIG. 1, based on a soot load of the engine. As elaborated herein with reference to FIGS. 2-3, an engine controller may adjust a fuel injection, specifically an amount of fuel direct injected to an amount of fuel port injected into an engine cylinder, based on an amount of particulate matter produced by the engine. The soot load may be estimated by a sensor in the engine exhaust, and/or may be inferred based on engine operating conditions. As elaborated with reference to FIGS. 4-5, the adjustment may be based on the fuel type available for direct injection and port injection. For example, the adjustment may be based on the alcohol content of the fuel being direct injected into the cylinder and/or port injected into the cylinder. By transitioning the fuel injection from a relatively higher amount of direct injection to a relatively higher amount of port injection as the soot load increases, exhaust emissions may be controlled. As shown in the example adjustment of FIG. 6, the transition may be adjusted not only based on the fuel types in the injectors, but also based on a rate of rise of the soot load. By decreasing an amount of direct injection and increasing an amount of port injection as a soot load exceeds a threshold, exhaust emissions may be controlled without degrading engine fuel economy.

FIG. 1 depicts an example embodiment of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (i.e. combustion chamber) 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 1, or may alternatively be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be any suitable sensor for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor. Emission control device 178 may be a three way catalyst (TWC), NOx trap, various other emission control devices, or combinations thereof.

Exhaust passage 148 may further include a particulate filter (not shown) upstream of emission control device 178 for storing particulate matter, or soot, released in the engine exhaust. The filter may be periodically regenerated to burn off the stored soot and restore the filter's storage capacity. In one example, a pressure sensor may be configured to estimate the soot load of the filter based on a pressure difference across the filter, and when the load exceeds a threshold, filter regeneration may be initiated. As elaborated herein with reference to FIGS. 3 and 7, a fuel injection to the cylinder may be adjusted based on the regeneration.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen for example when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including two fuel injectors 166 and 170. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from high pressure fuel system-1 172 including a fuel tank, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel in proportion to the pulse width of signal FPW-2 received from controller 12 via electronic driver 171. Fuel may be delivered to fuel injector 170 by fuel system-2 173 including a fuel tank, a fuel pump, and a fuel rail. Note that a single driver 168 or 171 may be used for both fuel injection systems, or multiple drivers, for example driver 168 for fuel injector 166 and driver 171 for fuel injector 170, may be used, as depicted.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load and/or knock, such as described herein below. The relative distribution of the total injected fuel among injectors 166 and 170 may be referred to as an injection ratio. For example, injecting a larger amount of the fuel for a combustion event via (direct) injector 166 may be an example of a higher ratio of direct injection, while injecting a larger amount of the fuel for a combustion event via (port) injector 170 may be a higher ratio of port injection. Note that these are merely examples of different injection ratios, and various other injection ratios may be used. Additionally, it should be appreciated that port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from a port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such each cylinder may similarly include its own set of intake/exhaust valves, fuel injector(s), spark plug, etc.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel systems 172 and 173 may hold fuel with different fuel qualities, such as different fuel compositions. These differences may include different alcohol content, different octane, different heat of vaporizations, different fuel blends, and/or combinations thereof etc. In one example, fuels with different alcohol contents could include one fuel being gasoline and the other being ethanol or methanol. In another example, the engine may use gasoline as a first fuel and an alcohol containing fuel blend such as E85 (which is approximately 85% ethanol and 15% gasoline) or M85 (which is approximately 85% methanol and 15% gasoline) as a second fuel. Other alcohol containing fuels could be a mixture of alcohol and water, a mixture of alcohol, water and gasoline etc. In still another example, both fuels may be alcohol blends wherein the first fuel may be a gasoline alcohol blend with a lower ratio of alcohol than a gasoline alcohol blend of a second fuel with a greater ratio of alcohol, such as E10 (which is approximately 10% ethanol) as a first fuel and E85 (which is approximately 85% ethanol) as a second fuel. Additionally, the first and second fuels may also differ in other fuel qualities such as a difference in temperature, viscosity, octane number, latent enthalpy of vaporization etc.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

Controller 12 may estimate a soot load of the engine (that is, an amount of particulate matter generated by the engine) and accordingly adjust a ratio of fuel injected through the direct injector and port injector. As elaborated herein with reference to FIG. 2-3, the controller may increase an amount of fuel that is port injected and decrease an amount of fuel that is direct injected as the soot load of the engine increases. The soot load may be estimated by controller 12 based on the engine operating conditions (such as engine speed and load). Additionally, or optionally, the soot load may be sensed by a particulate matter (PM) sensor 188 included in exhaust passage 148, for example, downstream of emission control device 178.

Storage medium read-only memory 110 can be programmed with computer readable data representing instructions executable by processor 106 for performing the methods described below as well as other variants that are anticipated but not specifically listed.

Figure 2:
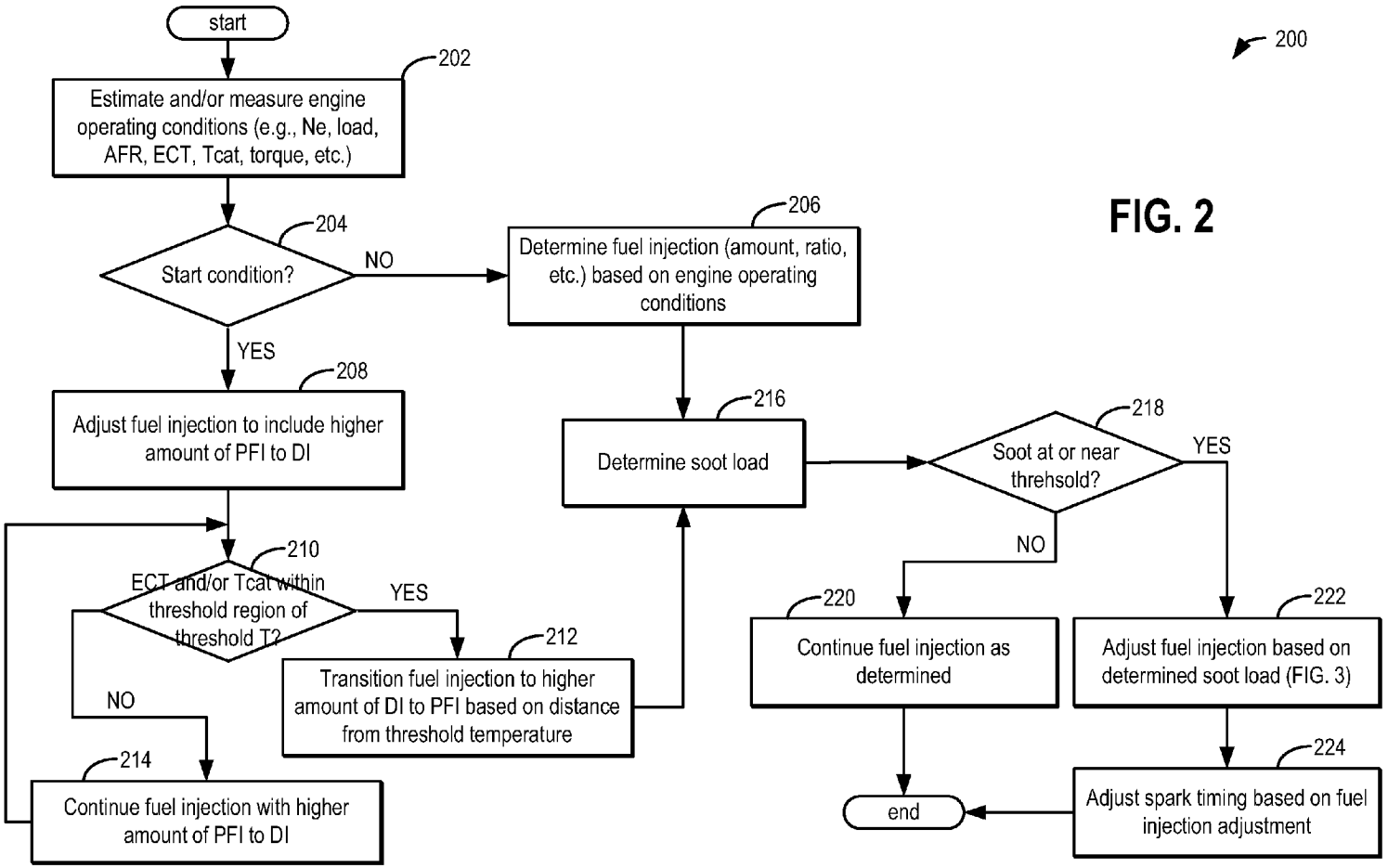
FIGS. 2-3 show high level flow charts for adjusting fuel injection based on an engine soot load.

Now turning to FIG. 2, an example routine 200 is shown for controlling a fuel injection to an engine cylinder including a (first) port injector and a (second) direct injector based on an amount of particulate matter produced by the engine.

At 202, engine operating conditions may be estimated and/or measured. These may include, for example, engine speed, engine load, cylinder air-to-injected fuel ratio (AFR), engine temperature (for example, as inferred from an engine coolant temperature), exhaust temperature, catalyst temperature (Tcat), desired torque, boost, etc.

At 204, it may be determined whether a start condition is present. In one example, the start condition may include an engine cold-start condition. In another example, the start condition may include an engine restart condition (such as, a restart soon after a preceding engine shut-down). As such, in a start condition, the engine temperature and/or the catalyst temperature may be below a desired threshold. For example, the catalyst temperature may be below a threshold catalyst light-off temperature. If a start condition is present, then at 208, a controller may adjust the fuel injection to the engine to include a relatively higher amount of port injection and a relatively smaller amount of direct injection of the injected fuel. Herein, port injection of fuel may be advantageously used to heat the engine and catalyst, thereby improving engine and catalyst performance under engine start conditions. At 210, it may be confirmed whether at least one of the engine temperature and the catalyst temperature is within a threshold region of the desired threshold temperature. If the engine and/or catalyst temperature has not increased sufficiently, then at 214, fuel injection may be continued with the higher amount of port injection to direct injection. The routine may then proceed to 216 wherein the engine soot load is determined.

In comparison, if the engine and/or catalyst temperature has increased and is within a threshold region of the threshold temperature, then at 212, the controller may start transitioning the fuel injection to the engine cylinder from the relatively higher amount of port fuel injection to a relatively higher amount of direct fuel injection. The transition may be adjusted based on a distance of the engine and/or catalyst temperature from the threshold temperature. For example, once the temperature is within a threshold region of the threshold temperature, a rate of the transition may be increased as the distance from the threshold temperature increases. This may include, gradually deactivating the port injector, while gradually activating the direct injector, as the temperature approaches the threshold temperature. Thus, by the time the engine and/or catalyst temperature is at, or beyond, the threshold temperature, the fuel injection may have been transitioned to a higher amount of direct fuel injection and a smaller amount of port fuel injection. Herein, by using a higher ratio of direct injection as an engine load (and thus, engine temperature) increases, the charge cooling and improved fuel economy benefits of a direct injected fuel may be availed.

If an engine start condition is not confirmed at 204, then at 206, a fuel injection may be determined based on the engine operating conditions as well as the fuel type. This may include determining an amount of fuel (or fuels) to be injected, as well as a ratio of the injected fuel that is delivered through the port injector and the direct injector. In one example, as an engine speed, engine load, and/or desired torque increases, an amount of fuel injected through the direct injector may be increased while an amount of fuel injected through the port injector may be decreased. Herein, the direct injection of the fuel may provide higher fuel efficiency and higher power output. Additionally, when the direct injected fuel is an alcohol fuel, the direct injection of the fuel may be used to take advantage of the charge cooling properties of the alcohol fuel.

At 216, a soot load of the engine may be determined. In one example, the soot load may be determined based on engine operating conditions, such as an engine speed-load condition. In another example, the soot load may be estimated by a particulate matter sensor coupled to the engine exhaust. In still another example, the soot load may be inferred based on a pressure difference across a particulate filter in the engine exhaust. At 218, it may be determined whether the estimated soot load is at or near a threshold. If the soot load is not beyond the threshold, then at 220, engine operation may continue with the fuel injection determined (at 206 or 212). In comparison, in response to the soot load exceeding the threshold, at 222, and as further elaborated in FIG. 3, the fuel injection may be adjusted based in the determined soot load, that is, the amount of particulate matter generated by the engine. At 224, spark timing adjustments may be performed based on the fuel injection adjustment to compensate for torque transients. For example, in response to a decrease in amount of port fuel injection and increase in the amount of direct fuel injection, spark ignition timing may be retarded by an amount. In alternate embodiments, additionally or optionally, adjustments may be made to one or more of boost, EGR, VCT, etc. to compensate for torque transients.

Figure 3:
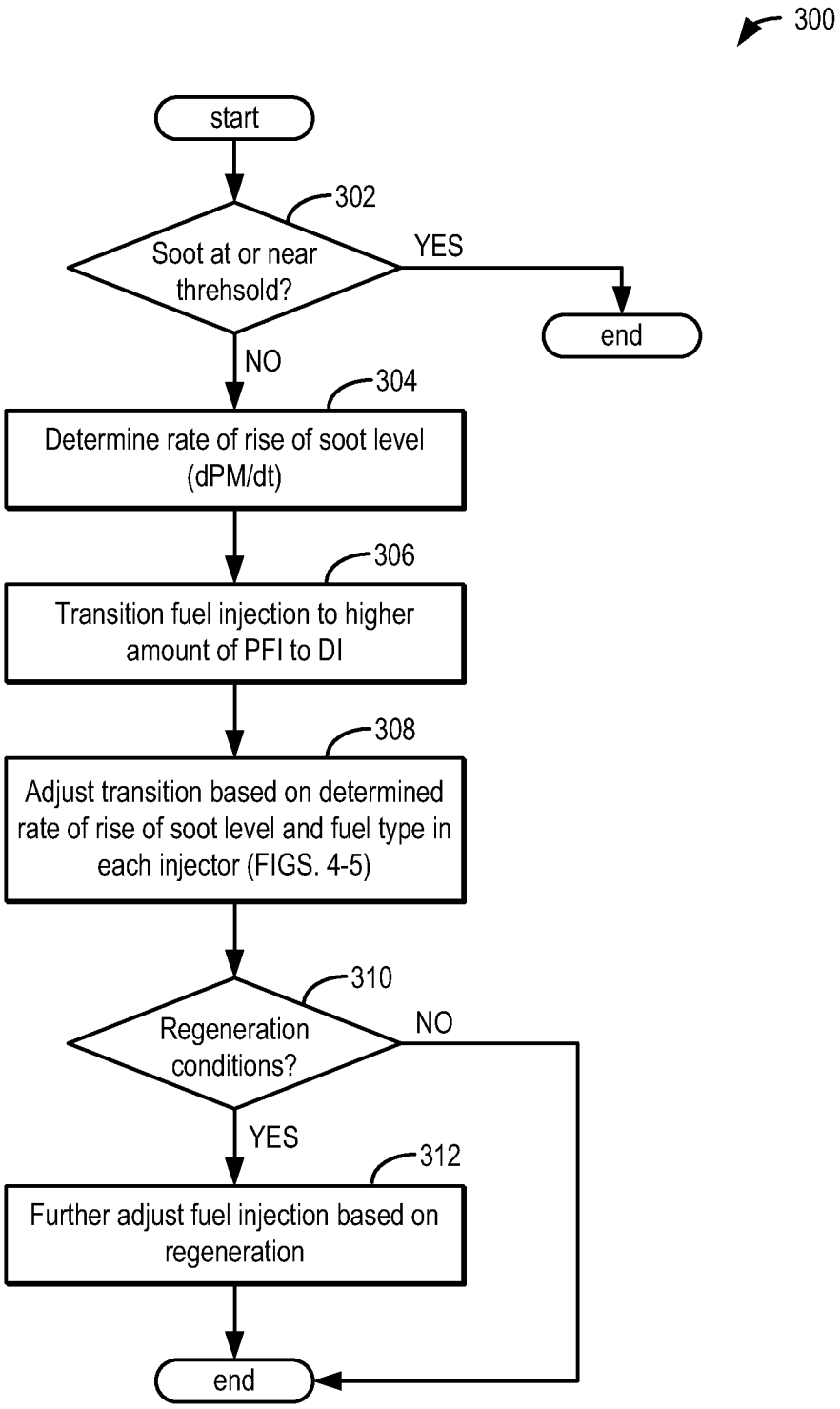

Now turning to FIG. 3, an example routine 300 is shown for adjusting a fuel injection amount to a cylinder among a port injector and a direct injector based on the amount of particulate matter generated by the engine, and further based on the fuel type.

At 302, it may be confirmed that the soot load is at or near the threshold. Upon confirmation, at 304, a rate of rise in the soot level (dPM/dt) may be estimated or inferred. At 306, in response to the soot load exceeding a threshold, a fuel injection amount between the port injector and the direct injector may be adjusted. Specifically, a fuel injection amount from the direct injector may be decreased while increasing a fuel injection amount from the port injector. Herein, by shifting, at least transiently, from a higher amount of direct injection to a higher amount of port injection in response to the rise in soot load, the soot generation by the direct injection of fuel may be reduced, thereby improving exhaust emissions.

At 308, the transition in fuel injection may be adjusted based on the fuel type in each injector as well as the rate of rise in soot load. Herein, the fuel type includes a fuel delivered by the direct injector and/or a fuel delivered by the port injector. In one example, this may further include an alcohol content of the fuel delivered by the direct injector. In another example, the fuel type may include a relative amount of alcohol in the fuel delivered by the direct injector as compared to the port injector. Thus, in one example, the increase in fuel injection amount from the port injector may be adjusted based on a first fuel injected by the port injector, while the decrease in fuel injection amount from the direct injector may be adjusted based on a second fuel injected by the direct injector.

In one example, the port injector and the direct injector may be configured to inject the same fuel. Herein, as shown in map 400 of FIG. 4, the decrease in fuel injection from the direct injector and the increase in fuel injection from the port injector may be smaller as the alcohol content of the fuel increases. In another example, the port injector and the direct injector may be configured to inject different fuels of differing alcohol content. Herein, as shown in map 500 of FIG. 5, when the alcohol content of the fuel delivered by the direct injector is higher and the amount of particulate matter is greater than the threshold, a fuel injection amount from the direct injector may be decreased by a first, smaller amount while increasing a fuel injection amount from the port injector by the first amount. In comparison, when the alcohol content of the fuel delivered by the direct injector is lower and the amount of particulate matter is greater than the threshold, the fuel injection amount from the direct injector may be decreased by a second, larger amount while increasing the fuel injection amount from the port injector by the second amount. That is, the increase in fuel injection amount from the port injector is smaller when the alcohol content of the first fuel is higher, and the decrease in fuel injection amount from the direct injector is smaller when the alcohol, content of the second fuel is higher.

The increase in fuel injection amount from the port injector and decrease in fuel injection amount from the direct injector may be further adjusted based on the rate of rise of the engine soot load. In one example, the adjustment may include increasing a rate of increase in fuel injection amount from the port injector, and increasing a rate of decrease in fuel injection amount from the direct injector when the rate of rise exceeds a threshold. That is, a rate of decreasing fuel injection from the direct injector and a rate of increasing fuel injection from the port injector may be increased (for example, changed substantially immediately) in response to a sudden and rapid increase in the amount of particulate matter, while the rates may be decreased (for example, changed gradually) in response to a gradual increase in the rise in soot load.

Returning to FIG. 3, at 310, it may be determined whether filter regeneration conditions are present. As such, filter regeneration may be determined in response to, for example, engine operating conditions including exhaust temperature, a soot load of the filter exceeding a threshold, and/or a pressure difference across the filter exceeding a threshold. If filter regeneration conditions are not confirmed, the routine may end and no further fuel injection adjustments may be performed. In comparison, if regeneration is confirmed, then at 312, the fuel injection amounts may be further adjusted in response to filter regeneration. Specifically, before regeneration, a fuel injection amount from the direct injector may be decreased and a fuel injection amount from the port injector may be increased in response to engine soot load exceeding a threshold. In comparison, after regeneration, a fuel injection amount from the direct injector may be increased (or decreased by a smaller amount) and a fuel injection amount from the port injector may be decreased (or increased by a smaller amount) increased in response to engine soot load exceeding a threshold.

As such, before regeneration, the soot load of a particulate filter may be higher and thus the storage capacity may be lower. Thus under these conditions, in response to a higher soot load of the engine, the fuel injection may be adjusted to decrease an amount of fuel direct injected, thereby decreasing an amount of PMs generated by the engine, thereby preemptively reducing the additional soot load that would have been added to the filter. In comparison, following regeneration, the soot load of a particulate filter may be lower and the storage capacity may be higher. Thus, under these conditions, the ability of the filter to store exhaust PMs generated by the direct injection may be higher. Thus, a decrease in direct injection and an increase in port injection may not be required, or may be reduced. Torque transients generated during the transition may be compensated for using spark retard.

In alternate embodiments, the regeneration of the particulate filter (for example, the initiation of filter regeneration) may be further adjusted based on the adjusted fuel injection amounts and fuel types.

Figure 6:
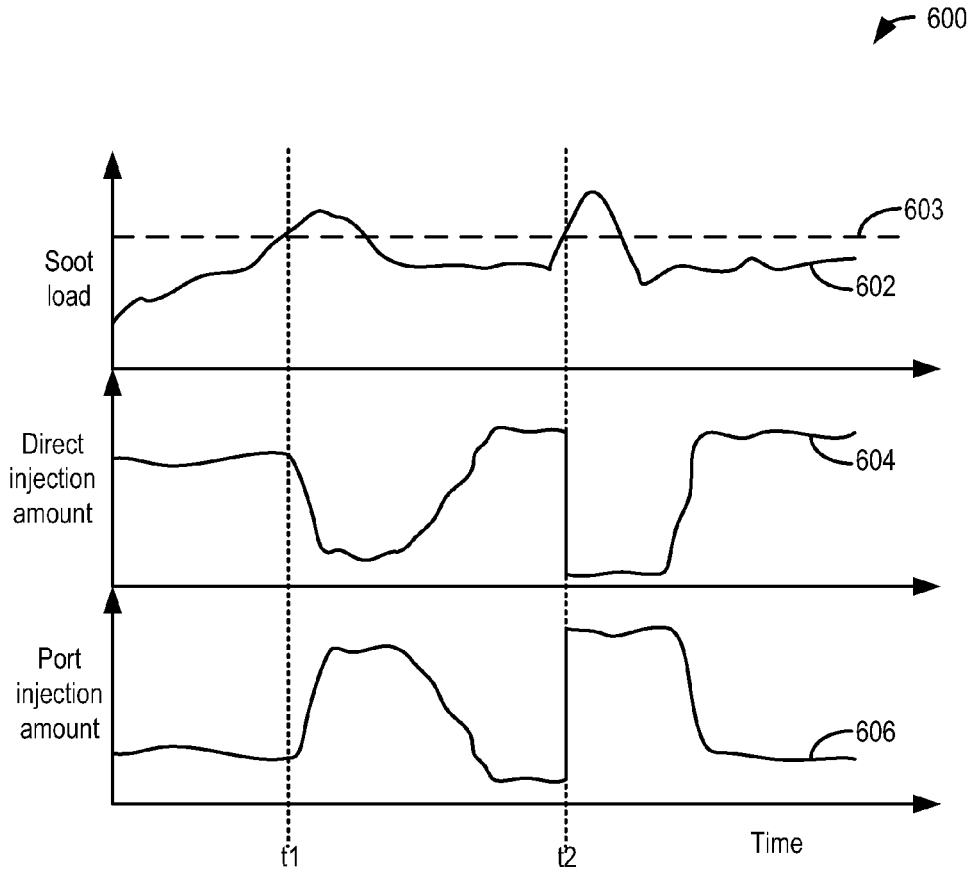
FIG. 6 shows an example fuel injection operation responsive to engine soot load, according to the present disclosure.

Now turning to FIG. 6, an example fuel injection adjustment responsive to a soot load of an engine is shown. The engine may include a first port injector injecting a first fuel into an engine cylinder and a second direct injector injecting a second fuel into the cylinder. A control system including a controller may be configured with computer readable instructions for activating and deactivating the first port injector and the second direct injector in response to an amount of particulate matter produced by the engine, for example, as sensed by a particulate matter sensor. Map 600 shows changes in engine soot load at graph 602, adjustment to a fuel injection amount of the direct injector at graph 604, and corresponding adjustments to a fuel injection amount of the port injector at graph 606.

Before t1, based on engine operating conditions, a fuel injection amount between the direct injector and the port injector may be determined. In the depicted example, a higher fuel injection amount from the direct injector and a lower fuel injection amount from the port injector may be determined. A soot load of the engine may be monitored. As shown, the soot load may increase and a rate of rise in soot load may be determined. In one example, before t1, the soot load may rise at a first, lower rate of rise. At t1, in response to the engine soot load exceeding a threshold 603, the fuel injection may be adjusted wherein the fuel injection amount from the direct injector is decreased while the fuel injection amount from the port injector is correspondingly increased.

As the amount of fuel direct injected is decreased, the engine soot load may start to decrease and fall below the threshold. When the soot load has fallen below the threshold, the fuel injection may be adjusted back to the higher amount of port injection and the lower amount of direct injection.

Before t2, the soot load may again start to rise, however at a second, higher rate of rise. Thus, at t2, in response to the engine soot load exceeding threshold 603, the fuel injection may be again adjusted wherein the fuel injection amount from the direct injector is decreased while the fuel injection amount from the port injector is correspondingly increased. Herein, the increase in the port injection amount and the decrease in the direct injection amount may occur at a faster rate (for example, as depicted herein, substantially instantaneously) in response to the rate of rise in soot load exceeding a threshold.

While not depicted, the injection amounts may be further adjusted based on the fuel type of the injected fuel. For example, when the second fuel injected by the direct injector has a higher alcohol content (such as E85), the decrease in fuel injection amount from the direct injector may be smaller as compared to when the second fuel injected by the direct injector has a lower alcohol content (such as E10 or gasoline). In another example, when the first fuel injected by the port injector has a smaller alcohol content (such as gasoline), the decrease in fuel injection amount from the direct injector may be smaller as compared to when the first fuel has a higher alcohol content (such as E85).

Figure 7:
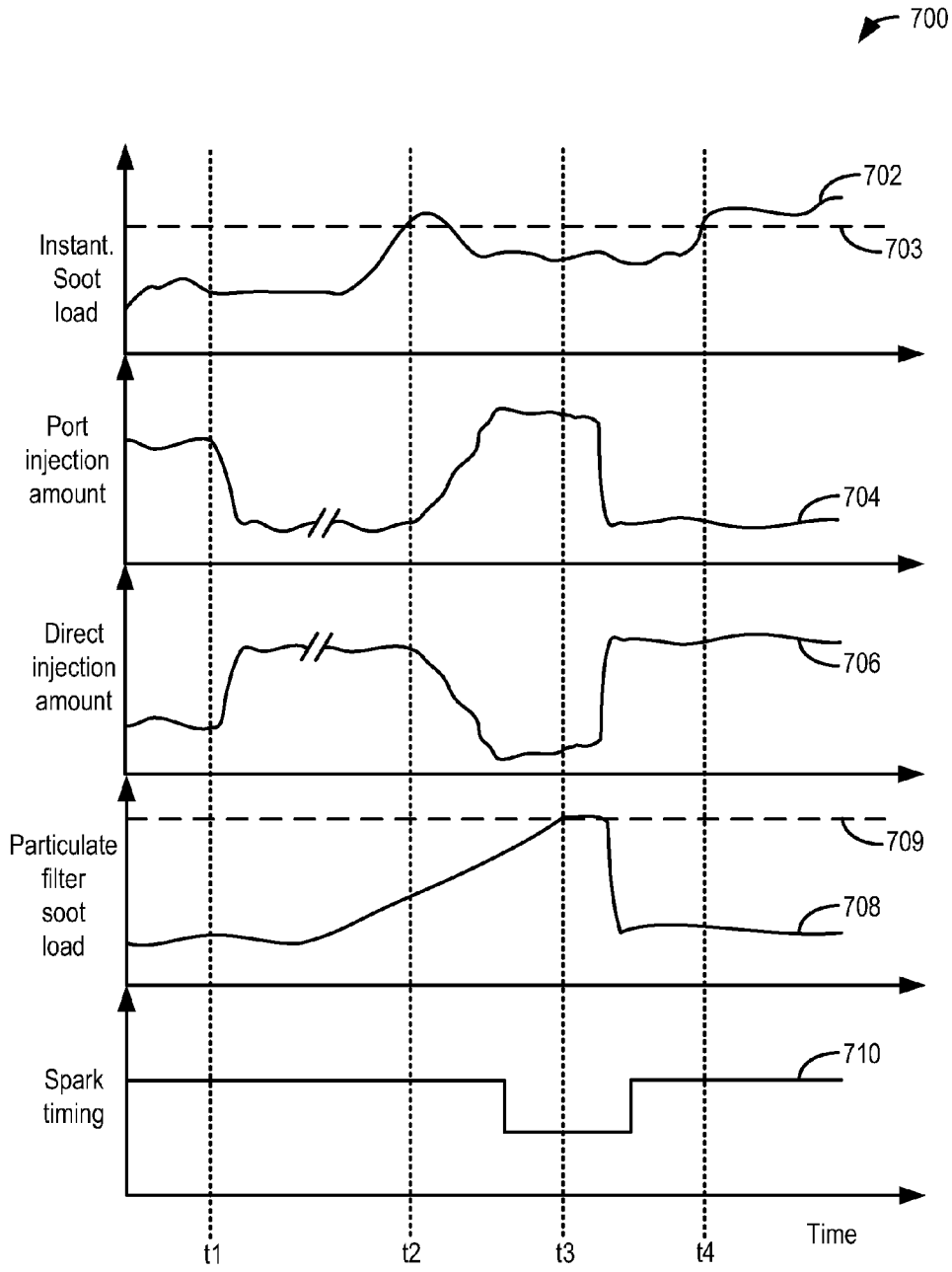
FIG. 7 shows an example fuel injection operation responsive to filter regeneration, according to the present disclosure.

Now turning to FIG. 7, an example fuel injection adjustment in coordination with filter regeneration is shown. Map 700 shows changes in engine instantaneous soot load at graph 702, adjustment to a fuel injection amount of the port injector at graph 704, adjustments to a fuel injection amount of the direct injector at graph 706, a particulate filter soot load at 708, and spark timing adjustments at 710.

Before t1, based on engine operating conditions, a fuel injection amount between the direct injector and the port injector may be determined. In the depicted example, a higher fuel injection amount from the port injector (704) and a lower fuel injection amount from the direct injector (706) may be determined. A soot load of the engine (702) and of the particulate filter (708) may be monitored.

At t1, in response to engine knock, a fuel injection amount from the direct injector may be increased while a fuel injection amount from the port injector is decreased. Herein, the direct injection of fuel may be advantageously used to provide cylinder charge cooling and reduce knock. As such, the fuel injection with a higher amount of direct injection and a lower amount of port injection may be continued for a period of time. As direct injection of fuel continues, an amount of PM generated by the engine may increase, thereby increasing the soot load of the engine and the filter. At t2, in response to the engine soot load exceeding a threshold 703, the fuel injection may be adjusted wherein the fuel injection amount from the direct injector is decreased while the fuel injection amount from the port injector is correspondingly increased.

As the amount of fuel direct injected is decreased, the instantaneous engine soot load may start to decrease and fall below the threshold. However, the soot load of the particulate filter may continue to increase an engine operation continues. At t3, in response to the filter soot load exceeding a threshold 709, filter regeneration may be initiated. As filter regeneration continues, the soot load of the filter may start to fall, thereby increasing the storage capacity of the filter. Thus, after regeneration, at t4, in response to the engine soot load increasing above the threshold, in anticipation of the filter being able to store additional soot generated by direct injection, the fuel injection amount from the direct injector may be increased (or maintained at the higher amount) and a fuel injection amount from the port injector may be decreased (or maintained at the lower amount). Torque adjustments may be provided by adjusting a spark timing, for example, by transiently retarding spark, as shown at 710. In this way, the fuel injection adjustment may be coordinated with filter regeneration.

In this way, by adjusting an engine fuel injection amount between a direct injector and a port injector based on the soot load of the engine and further based on the fuel type, the fuel efficiency and power output advantages of direct injection may be achieved without degrading exhaust emissions.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various steps, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated steps or functions may be repeatedly performed depending on the particular strategy being used. Further, the described steps may graphically represent code to be programmed into the computer readable storage medium in the engine control system.

It will be further appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system, comprising,
an engine with a turbocharger;
a particulate matter sensor coupled to the engine;
a first port injector injecting a first fuel into a cylinder;
a second direct injector injecting a second fuel into the cylinder; and
a control system with computer readable instructions for activating and deactivating the first port injector and the second direct injector in response to an amount of particulate matter produced by the engine and engine starting.

2. The system of claim 1, wherein the amount of particulate matter produced by the engine is estimated by the particulate matter sensor and/or inferred based on engine operating conditions.

3. The system of claim 1, wherein the activating and deactivating includes activating the first port injector to increase fuel injection of the first fuel and deactivating the second direct injector to decrease fuel injection of the second fuel as the amount of particulate matter produced by the engine exceeds a threshold.

4. The system of claim 3, wherein the increase is adjusted based on an alcohol content of the first fuel and wherein the decrease is adjusted based on an alcohol content of the second fuel, the adjustment including increasing fuel injection of the first fuel by a smaller amount when the alcohol content of the first fuel is lower, and decreasing fuel injection of the second fuel by a smaller amount when the alcohol content of the second fuel is higher.

5. The system of claim 4, wherein a rate of the increase and a rate of the decrease is adjusted based on a rate of rise in the amount of particulate matter, the adjustment including increasing a rate of activation and deactivation as the rate of rise exceeds a threshold.

6. The system of claim 1, further comprising a particulate filter for storing particulate matter, wherein the control system further includes instructions for adjusting the activation and deactivation in response to regeneration of the particulate filter.

7. A method of operating an engine including a first port injector injecting a first fuel into an engine cylinder and a second direct injector injecting a second fuel into the cylinder, comprising:

injecting higher amounts from the first injector than the second injector in response to an engine starting condition; and injecting higher amounts from the first injector than the second injector in response to a soot load of the engine after the engine starting.

8. The method of claim 7 further comprising transitioning from the higher amounts of injection by the first injector to higher amounts of injection from the second injector after the engine starting condition.

9. The method of claim 8 wherein the transitioning is in response to a distance of the engine and/or catalyst temperature from a threshold temperature.

10. The method of claim 8 wherein once a catalyst temperature is within a threshold region of a threshold temperature, gradually deactivating the port injector, while gradually activating the direct injector.

11. The method of claim 8 wherein the transitioning includes operating the engine with a higher ratio of direct injection from the second injector as an engine load increases.

12. The method of claim 7 wherein injection from the first and second injectors is adjusted in response to fuel alcohol content.

13. The method of claim 7, wherein the soot load is estimated by a particulate matter sensor coupled to the engine.

14. The method of claim 7, wherein the soot load is inferred based on engine operating conditions including engine speed and load.

15. A method of controlling fuel injection to an engine cylinder having a first port injector and a second direct injector, comprising, adjusting fuel injection amounts among the first port injector and the second direct injector in response to an amount of particulate matter and a fuel alcohol content, and in response to engine starting.

16. The method of claim 15, wherein the fuel alcohol content includes an alcohol content in fuel delivered by the second direct injector.

17. The method of claim 15, wherein the fuel alcohol content includes a relative alcohol content in fuel delivered by the second direct injector as compared to the first port injector.

18. The method of claim 16, wherein the adjustment includes, when the alcohol content of the fuel delivered by the second injector is higher and the amount of particulate matter is greater than a threshold, decreasing a fuel injection amount from the direct injector by a first, smaller amount and increasing a fuel injection amount from the port injector by the first amount; and when the alcohol content of the fuel delivered by the second injector is lower and the amount of particulate matter is greater than a threshold, decreasing the fuel injection amount from the direct injector by a second, larger amount and increasing the fuel injection amount from the port injector by the second amount.

19. The method of claim 18, wherein a rate of decreasing fuel injection from the direct injector and a rate of increasing fuel injection from the port injector are increased in response to a rapid increase in the amount of particulate matter.

20. The method of claim 15, wherein the fuel injection amounts are further adjusted in response to particulate filter regeneration.

21. The method of claim 20, wherein the adjustment includes, before regeneration, decreasing a fuel injection amount from the direct injector and increasing a fuel injection amount from the port injector; and after regeneration, increasing the fuel injection amount from the direct injector and decreasing a fuel injection amount from the port injector.

22. The method of claim 15, further comprising, adjusting regeneration of a particulate filter based on the adjusted fuel injection amounts.

* * * * *